US010399758B2

(12) United States Patent
Vercoe et al.

(10) Patent No.: US 10,399,758 B2
(45) Date of Patent: Sep. 3, 2019

(54) CHILD-RESISTANT PACKAGE ASSEMBLY

(71) Applicant: WestRock MWV, LLC, Atlanta, GA (US)

(72) Inventors: Elizabeth A. Vercoe, Richmond, VA (US); Marty Jones, Glen Allen, VA (US); Steven P. Jones, Elon, NC (US)

(73) Assignee: WestRock MWV, LLC, Atlanta, GA (US)

( * ) Notice: Subject to any disclaimer, the term of this patent is extended or adjusted under 35 U.S.C. 154(b) by 0 days.

(21) Appl. No.: 16/251,173

(22) Filed: Jan. 18, 2019

(65) Prior Publication Data

US 2019/0161261 A1 May 30, 2019

Related U.S. Application Data

(63) Continuation of application No. 14/857,366, filed on Sep. 17, 2015, now abandoned.

(51) Int. Cl.

| | |
|---|---|
| ***B65D 75/58*** | (2006.01) |
| ***B65D 83/04*** | (2006.01) |
| ***A61J 7/04*** | (2006.01) |
| ***B65D 5/38*** | (2006.01) |
| ***B65D 5/42*** | (2006.01) |

(52) U.S. Cl.

CPC ..... *B65D 75/58* (2013.01); *A61J 7/04* (2013.01); *B65D 5/38* (2013.01); *B65D 5/4237* (2013.01); *B65D 83/0463* (2013.01); *B65D 2215/04* (2013.01)

(58) Field of Classification Search

CPC .. B65D 83/0463; B65D 2215/02; B65D 5/38; B65D 75/327; A61J 1/035

USPC ..... 206/531, 528, 538, 532, 534; 229/125.125, 100, 122, 125.15, 220, 72

See application file for complete search history.

(56) References Cited

U.S. PATENT DOCUMENTS

| | | | | |
|---|---|---|---|---|
| 3,743,084 | A * | 7/1973 | Douglas | B65D 75/327 206/532 |
| 6,024,222 | A * | 2/2000 | Friberg | B65D 75/38 206/531 |
| 6,219,997 | B1 * | 4/2001 | Friberg | B65D 75/38 53/453 |
| 6,273,260 | B1 * | 8/2001 | ColDepietro | A61J 1/035 206/459.5 |
| 6,957,914 | B2 * | 10/2005 | Arends | B65D 33/06 383/204 |
| 7,748,534 | B2 * | 7/2010 | Jeannin | B65D 77/0413 206/528 |
| 7,866,476 | B2 * | 1/2011 | McGonagle | A61J 1/035 206/472 |
| 8,567,606 | B2 * | 10/2013 | Bellamah | B65D 83/0463 206/462 |
| 2006/0042987 | A1 * | 3/2006 | Buss | B65D 83/0463 206/532 |

(Continued)

*Primary Examiner* — Chun Hoi Cheung
*Assistant Examiner* — Brijesh V. Patel
(74) *Attorney, Agent, or Firm* — WestRock IP Legal

(57) ABSTRACT

Disclosed are package assemblies and methods of making the same, wherein the assemblies can include, among other elements, an outer carton defining an interior product storage compartment; an inner product support card slidably received within the product storage compartment; the inner support card having a main body portion and one or more flaps; and one or more primary product packages, each being secured to one of the one or more flaps.

18 Claims, 9 Drawing Sheets

(56) References Cited

U.S. PATENT DOCUMENTS

| | | | | |
|---|---|---|---|---|
| 2009/0184023 | A1* | 7/2009 | Brollier | A61J 1/035<br>206/531 |
| 2011/0042375 | A1* | 2/2011 | Jones | B65D 5/38<br>220/6 |

* cited by examiner

CHILD-RESISTANT PACKAGE ASSEMBLY

CROSS REFERENCE TO RELATED APPLICATIONS

This application is a Continuation of U.S. application Ser. No. 14/857366 filed on Sep. 15, 2015, which is hereby incorporated by reference in its entirety.

BACKGROUND OF THE INVENTION

Field of the Invention

The subject disclosure relates to package assemblies for products, such as medicaments, and more particularly to, package assemblies that include an outer carton and an inner product support card onto which at least one primary product package, such as a foil blister pouch, is secured, and still more particularly to, package assemblies that include child resistant and/or tamper evident features.

Background of the Related Art

Individual packages for medicaments are well known in the art and are typically provided as physician samples, dose prescriptions, over-the-counter pharmaceuticals, and the like. Such packaging usually contains medicaments which may be harmful, if ingested by a young child. Accordingly, the problem associated with the use of such packages is the ease in which the packaging may be opened by small children as a result of insufficient resistance.

In recent years, a great deal of effort has been directed toward providing packaging for medicaments which contains sufficient impediments to access to the packaged drugs to prevent children from easily opening the package. A popular type of child-resistant package currently on the market is the so-called "peel-push" packaging in which tablets are contained in individual flexible blisters of a thermoplastic material and sealed by a rupturable foil material which is in turn covered by a protective layer. Access to the tablets is selectively obtained by peeling off the protective layer to expose a rupturable foil material and pushing the tablet through the rupturable material by pressing on the blister.

Although child-resistant packaging such as that described above has proved to be successful in being effective in the prevention of children gaining access to the packaged medicament, these "child-resistant" packages do not provide easy access to the packaged medicaments to adults who are able to follow the directions for opening the package.

Therefore, there is a need for packaging assemblies, for items such as medicaments, which resolve the deficiencies of the prior art product packages discussed above. Moreover, there is a need for packaging assemblies which are easy to use and capable of storing one or more inner primary product packages. Still further, it would be advantageous to provide packaging assemblies which include child-resistant and/or tamper-resistant feature, but can be easily operated by adult consumers, such as elderly patients.

SUMMARY OF THE INVENTION

The present disclosure is directed to a package assembly that includes, inter alia, an outer carton defining an interior product storage compartment; an inner product support card slidably received within the product storage compartment; the inner support card having a main body portion and one or more flaps; and one or more primary product packages, each being secured to one of the one or more flaps.

In an embodiment of the present disclosure, the primary product packages are foil blister pouches. However, those skilled in the art will readily appreciate that alternative primary packages can be used without departing from the inventive aspects of the present disclosure and the primary packages can be used to store one or more products/items, such as medicaments.

It is envisioned that the inner product support card can be made from two layers of paperboard. Those skilled in the art will appreciate that other materials can be used to form the inner product support card, such as a polymer based substrate. In certain constructions, the two layers of paperboard are joined through a fold line. It is further envisioned that the product support card can include two flaps and two primary product packages, each being secured to one of the flaps. In an embodiment of the package assembly the one or more flaps are formed along a longitudinal edge of the product support card. Alternatively, the product support card can include two flaps and two primary product packages wherein the two flaps extend from a middle section of the product support card. In such a construction, it is envisioned each flap can have a lifting tab extending from an edge thereof.

It is envisioned that the primary product packages are heat sealed, adhered with tape, or adhered with glue to the flaps.

In a preferred embodiment, the outer carton includes a release mechanism formed on a wall for the carton and an inner securing ledge and the product support card includes a locking tail extending from an end of the main body portion. The locking tail engages with the securing ledge of the outer carton to prevent removal of the product support card from with the product storage compartment. However, actuation of the release mechanism disengages the locking tail from the securing ledge thereby allowing the product support card to be at least partially removed from with the product storage compartment. In certain constructions, the release mechanism is a push button which has been formed in the wall of the carton.

The present disclosure is further directed to an inner product support card blank that includes first and second card sections separated by a fold line which extends along a central axis for the blank, and first and second flaps. Each card section includes a first panel and a second panel connected through a hinge panel and the first and second flaps extend from at least one of the first and second card sections. In certain embodiments, first and second flaps extend from each of the first and second card sections. Moreover, a tail flap can be provided which extends from an end of the second card section.

The present disclosure is further directed to an inner product support card blank that includes, first and second card sections separated by a fold line which extends along a central axis for the blank. Each card section includes a first panel and a second panel connected through a hinge panel; and wherein first and second flap sections are defined in the first and second panels of the first card section. It is envisioned that the first and second flap sections can be defined in the first and second panels by a series of cut and/or perforation lines. Moreover, the first and second flap sections can include a lifting tab which extends from an edge thereof.

The present disclosure is directed to a child-resistant package assembly that includes, inter alia, an outer carton that defines an interior product storage compartment. The outer carton has a release element formed on a wall for the carton and a securing ledge formed in an inner surface of the wall. It is envisioned that in certain constructions, the release mechanism is a push button which has been formed in the wall of the carton.

The package assembly also includes an inner product support card and one or more primary product packages, such as foil pouch blister elements. The product support card is slidably received within the product storage compartment and includes a main body portion, a locking tail extending from an end of the main body portion and one or more flaps.

The one or more primary product packages are each secured to one of the one or more flaps. In certain embodiments of the packaging assembly of the present disclosure, the product support card includes two flaps and two primary product packages. Moreover, in an embodiment, the one or more flaps are formed along a longitudinal edge of the product support card. Alternatively, the product support card can include two flaps that extend from a middle section of the product support card. It is envisioned that a variety of methods can be used to secure the primary product packages to the flap(s), including heat sealing, adhering with tape or glue.

After assembly, the locking tail of the product support card engages with the securing ledge of the outer carton to prevent removal of the product support card from with the product storage compartment. Actuation of the release element disengages the locking tail from the securing ledge thereby allowing the product support card to be at least partially removed from with the product storage compartment.

In certain embodiments of the present disclosure, the outer carton of the package assembly includes a cover flap which extends from a longitudinal edge of a main carton body. The cover flap can be used display indicia, such as the product name or other product related information (e.g., drug related data or instructions). Preferably, the cover flap can be attached to the main carton body through a fold line and a perforation line which must be severed in order to access the release element. In other words, the cover flap can overlay the release element and prevent unauthorized access to the medicaments or other product contained in the foil pouch blister element. Severing of the perforation line is required in order to be able to lift the cover flap and expose the release element. As a result, the package assembly is tamper-evident because the severed score line will provide a clear visual indication as to whether anyone has previously accessed to the stored contents.

In certain embodiments of the present disclosure, the outer carton includes a second securing ledge which extends from the wall into the product storage compartment which engages with the securing tail to prevent the complete removal of the inner support card from the interior compartment.

It is envisioned that the inner product support card can be made from two layers of paperboard. The two layers of paperboard can be joined through a fold line or can be two distinct sheets. In either instance the layers can be glued or heat sealed to form a unitary card structure.

Preferably, first and second thumb notches are defined in the wall of the outer carton. These thumb notches can provide finger access to the inner support card to aid in removing the card from within the interior compartment of the carton. In certain constructions, the first and second thumb notches are misaligned with respect to a longitudinal axis for the outer carton which serves to further enhance the child-resistant features of the package assembly.

BRIEF DESCRIPTION OF THE DRAWINGS

So that those having ordinary skill in the art to which the present invention pertains will more readily understand how to employ the devices and methods of the present disclosure, embodiments thereof will be described in detail hereinbelow with reference to the drawings, wherein.

These and other aspects of the subject disclosure will become more readily apparent to those having ordinary skill in the art from the following detailed description of the invention taken in conjunction with the drawings.

DETAILED DESCRIPTION OF PREFERRED EMBODIMENTS

Disclosed herein are detailed descriptions of specific embodiments of packaging assemblies, methods and systems. It will be understood that the disclosed embodiments are merely examples of the way in which certain aspects of the invention can be implemented and do not represent an exhaustive list of all of the ways the invention may be embodied. Indeed, it will be understood that the systems, devices and methods described herein may be embodied in various and alternative forms. Moreover, the figures are not necessarily to scale and some features may be exaggerated or minimized to show details of particular components.

Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention. Moreover, the packaging assemblies are described herein as being used to store medicaments in a child-resistant manner. However, other items could be stored using the disclosed packing embodiments and the packaging assembly can be provided with or without child-resistant features.

The present disclosure now will be described more fully, but not all embodiments of the disclosure are necessarily shown. In addition, many modifications may be made to adapt a particular situation or material to the teachings of the disclosure without departing from the essential scope thereof.

Figure 1:
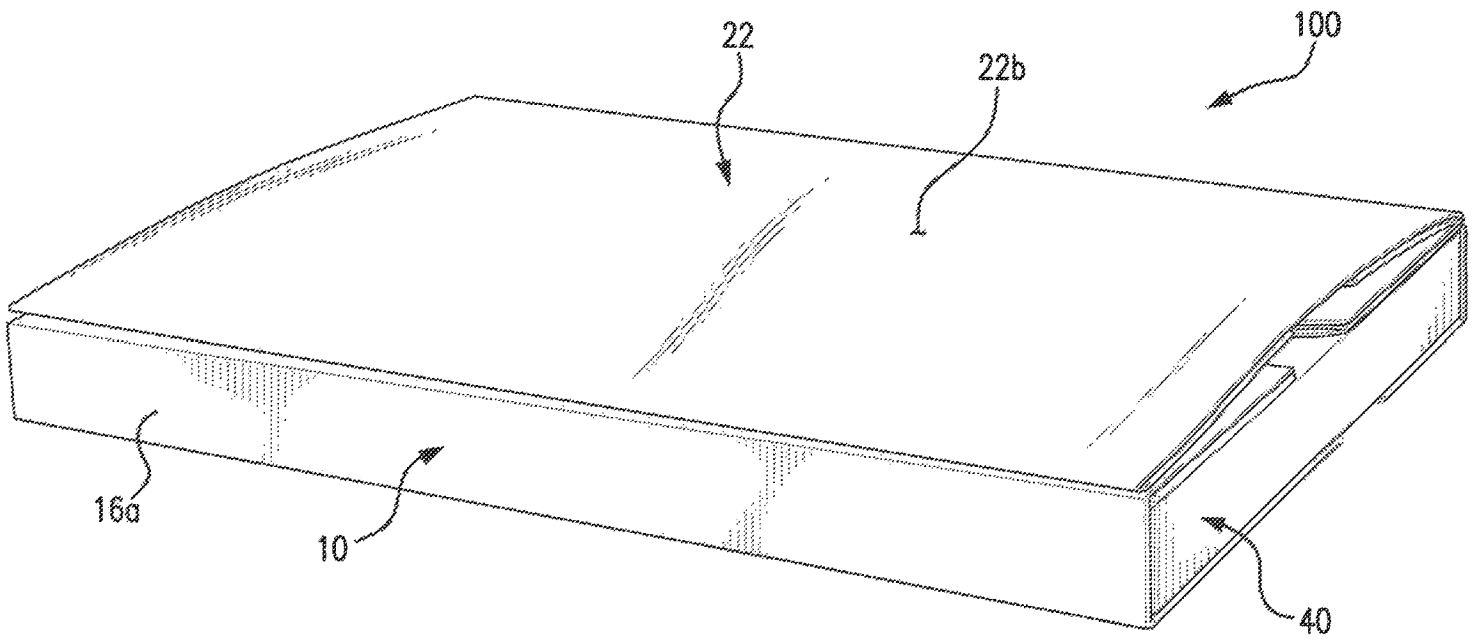
FIG. 1 illustrates a perspective view of a packaging assembly which has been constructed in accordance with a first embodiment of the present invention.
Figure 2:
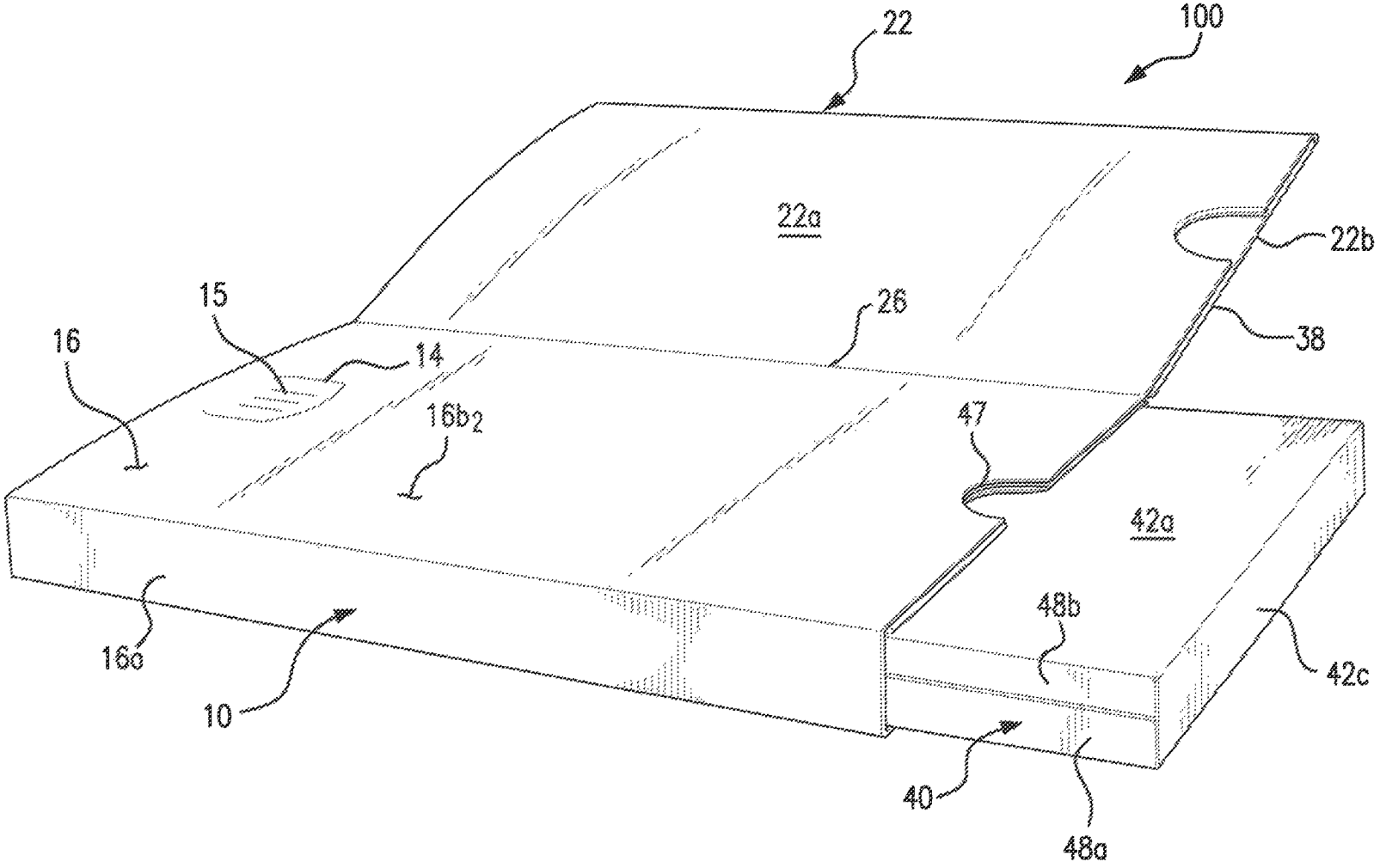
FIG. 2 illustrates a perspective view of the packaging assembly of FIG. 1 wherein an inner product support card has been partially withdrawn from within an interior compartment defined by an outer carton.
Figure 3:
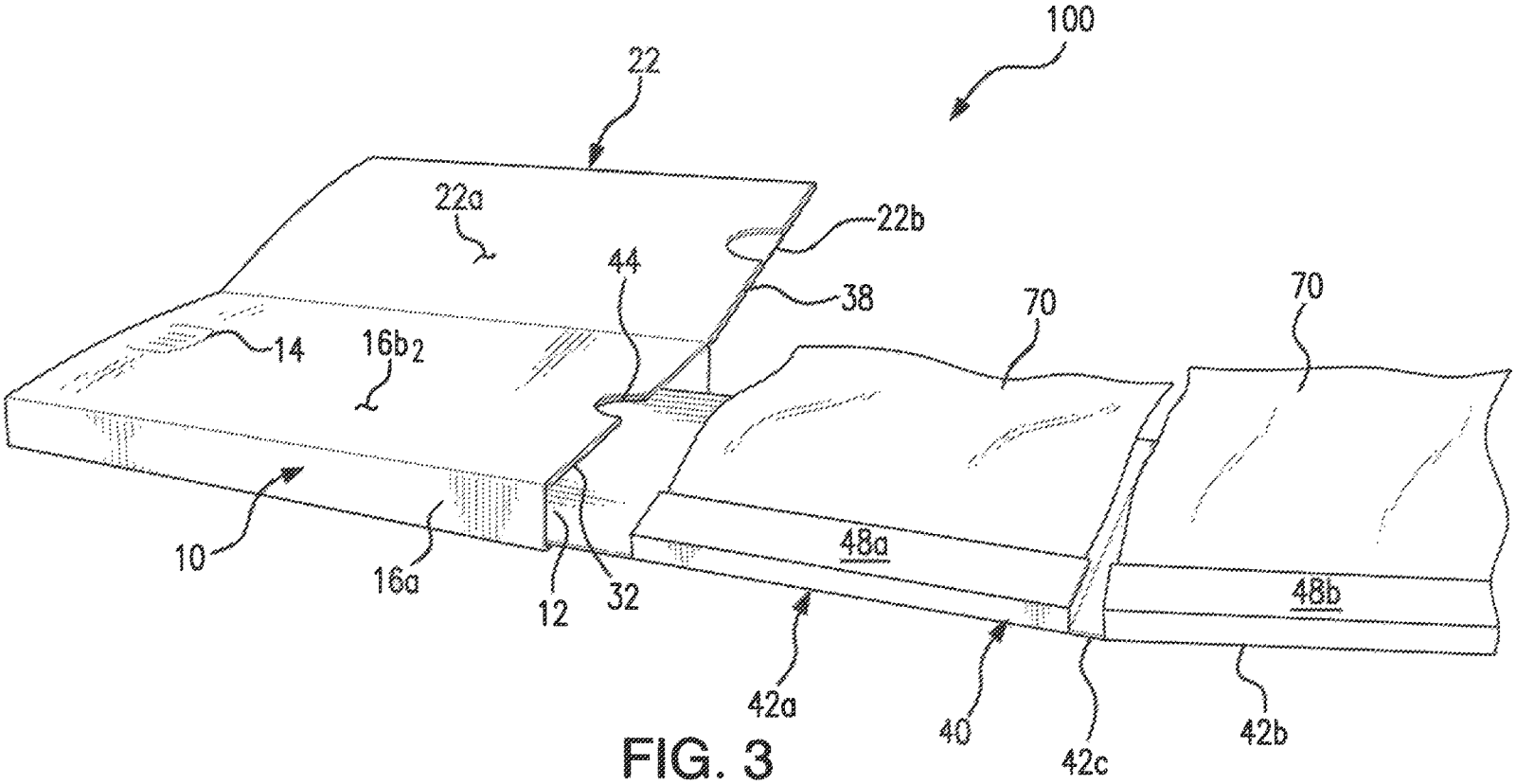
FIG. 3 illustrates a perspective view of the packaging assembly of FIG. 1 wherein the inner product support carton has been withdrawn from the interior compartment and the foil blister pouches exposed.
Figure 4:
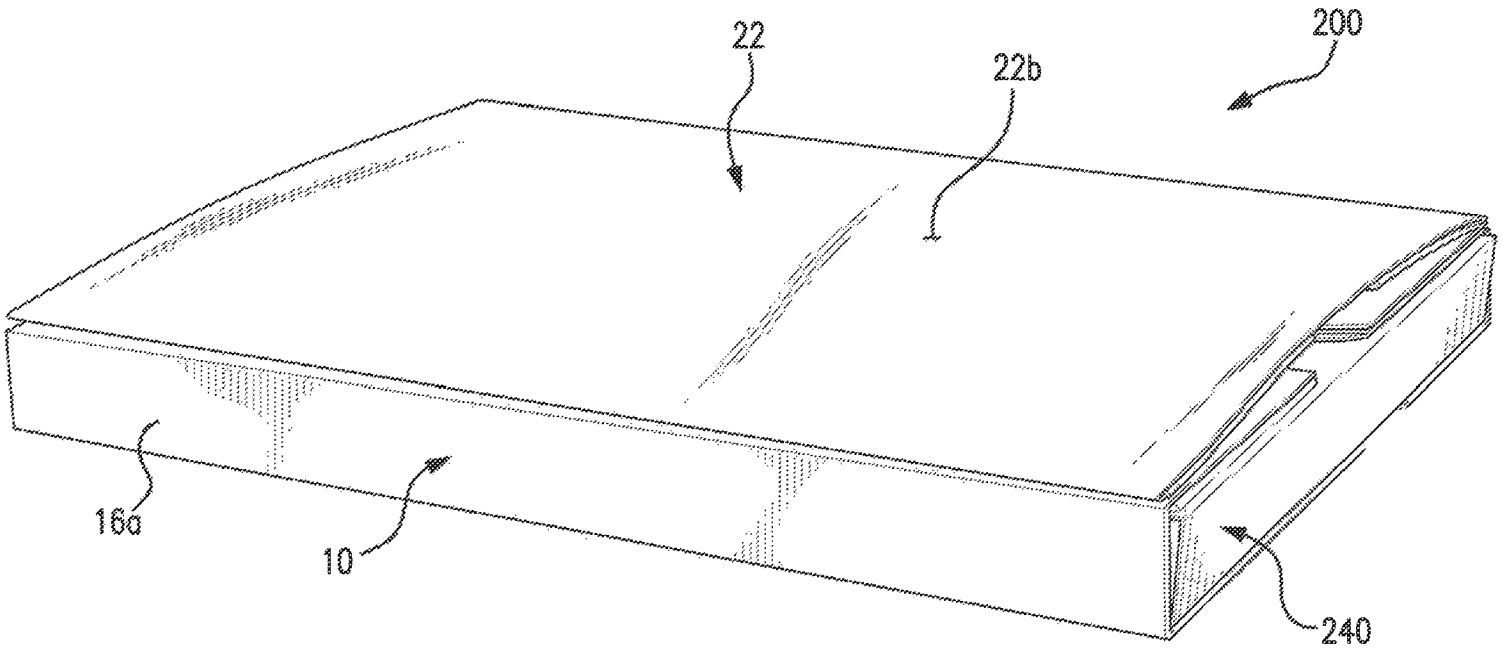
FIG. 4 illustrates a perspective view of a packaging assembly which has been constructed in accordance with a second embodiment of the present invention.
Figure 5:
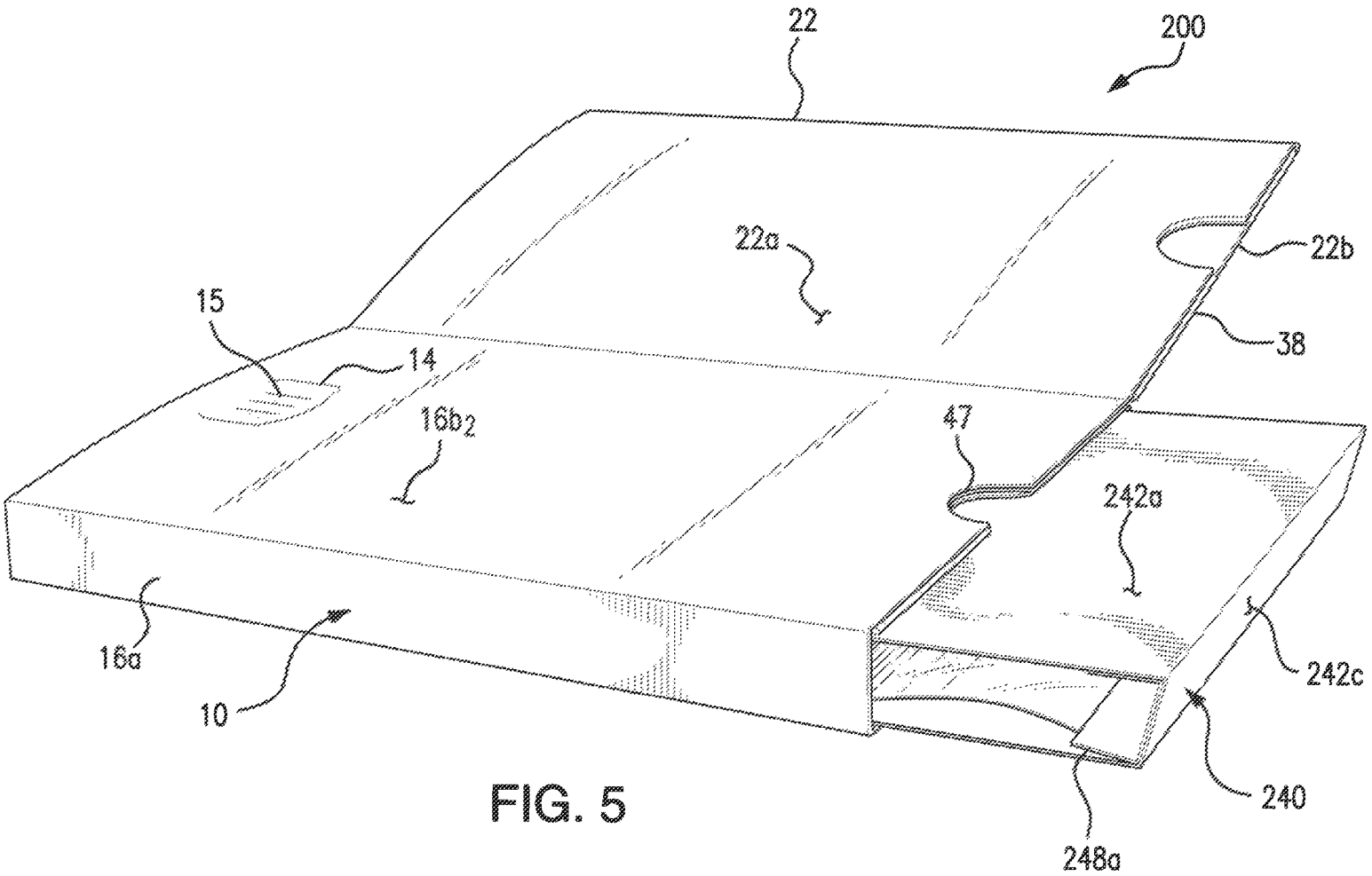
FIG. 5 illustrates a perspective view of the packaging assembly of FIG. 4 wherein an inner product support card has been partially withdrawn from within an interior compartment defined by an outer carton.

Referring now to FIGS. 1 through 3, there is illustrated a packaging assembly 100 which has been constructed in accordance with a first embodiment of the present disclosure. As will be described in detail below, packaging assembly 100 provides a tamper-evident and child-resistant package for storing items such as medicaments which can be provided in, for example, one or more foil blister pouches or primary packages.

Packaging assembly 100 includes, inter alia, an outer carton 10 and an inner product support card 40. The outer carton 10 defines an interior product storage compartment 12 (see FIG. 3) into which the inner product support card 40 is received. The outer carton 10 has a release mechanism 14 formed on a wall 16 for the carton and a securing ledge 18 (see FIG. 7) formed in an inner surface 20 of the wall. Those skilled in the art will appreciate that the location of the release mechanism 14 can vary without departing from the inventive aspects of the present disclosure. Also, wall 16 for carton 10 includes lateral side wall panels 16*a* and 16*c* (not shown) and top wall panel 16*b* and bottom wall panel 16*d* (not shown).

Figure 7:
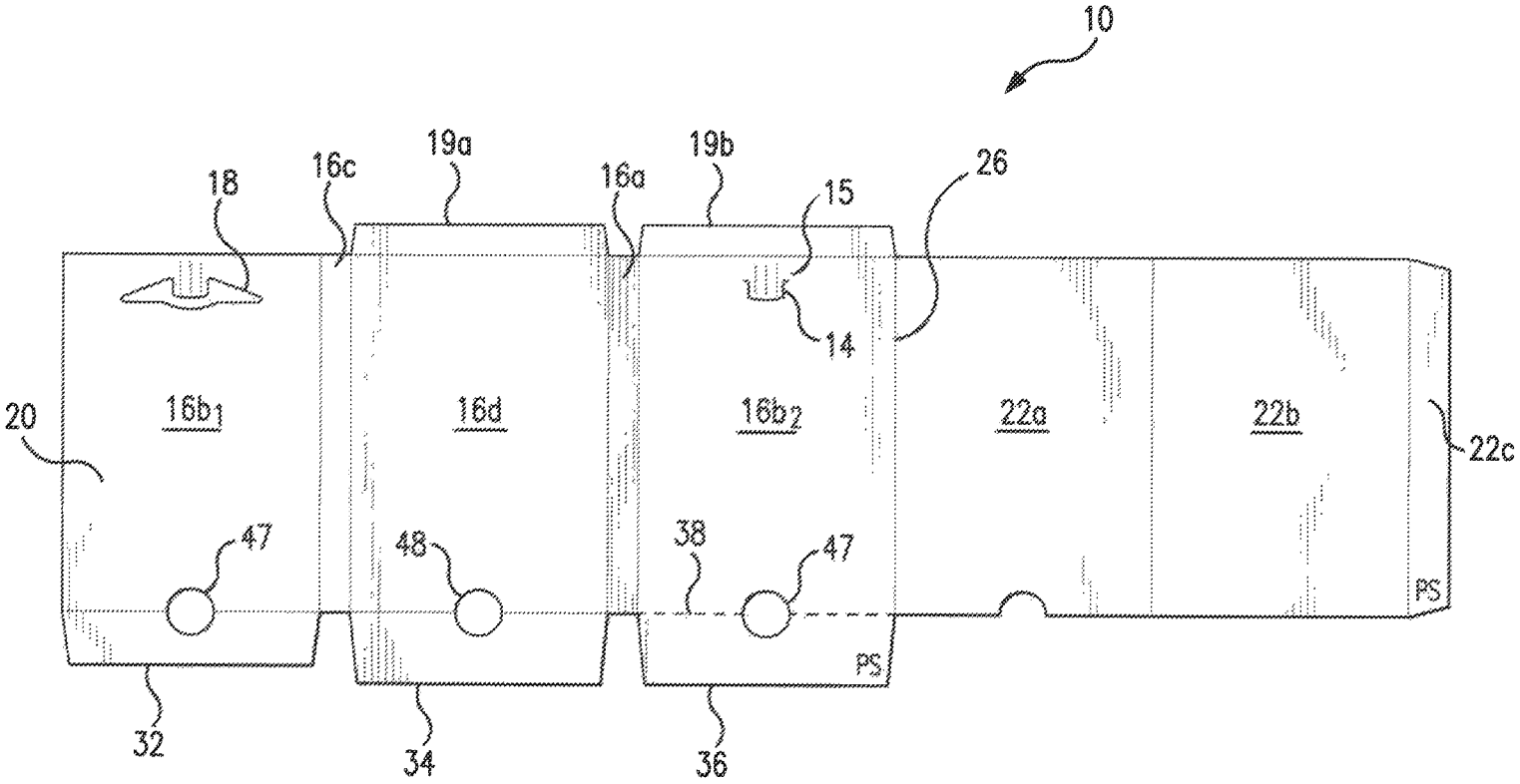
FIG. 7 is a plan view of a blank for use in making an outer carton used in the packaging assembly embodiments of FIGS. 1 and 4.

Since the securing ledge 18 is formed on the inside of carton 20 it is not visible in FIGS. 1-3 and is best illustrated in FIG. 7 which represents the carton blank for outer carton 10. As will be discussed below, wall 16 can be constructed using a single ply of material or the wall can be constructed using multiple layers of paperboard material which have been glued together.

As shown in FIGS. 2 and 3, the release mechanism 14 is a push button which has been formed by making a U-shaped cut-line in the top wall panel 16*b* of carton 10. Those skilled in the art will readily appreciate that the release mechanism can have a different shape or could be represented as a hole provided in the wall which allows finger access to the securing mechanism discussed below. Moreover, the user could be directed to a location on the wall which when pressed acts as the release mechanism. In the embodiment shown in these figures, a series of creases 15 have made in the paperboard adjacent to the release mechanism 14 in order to provide some local stiffness the top wall panel 16*b*.

Figure 8:
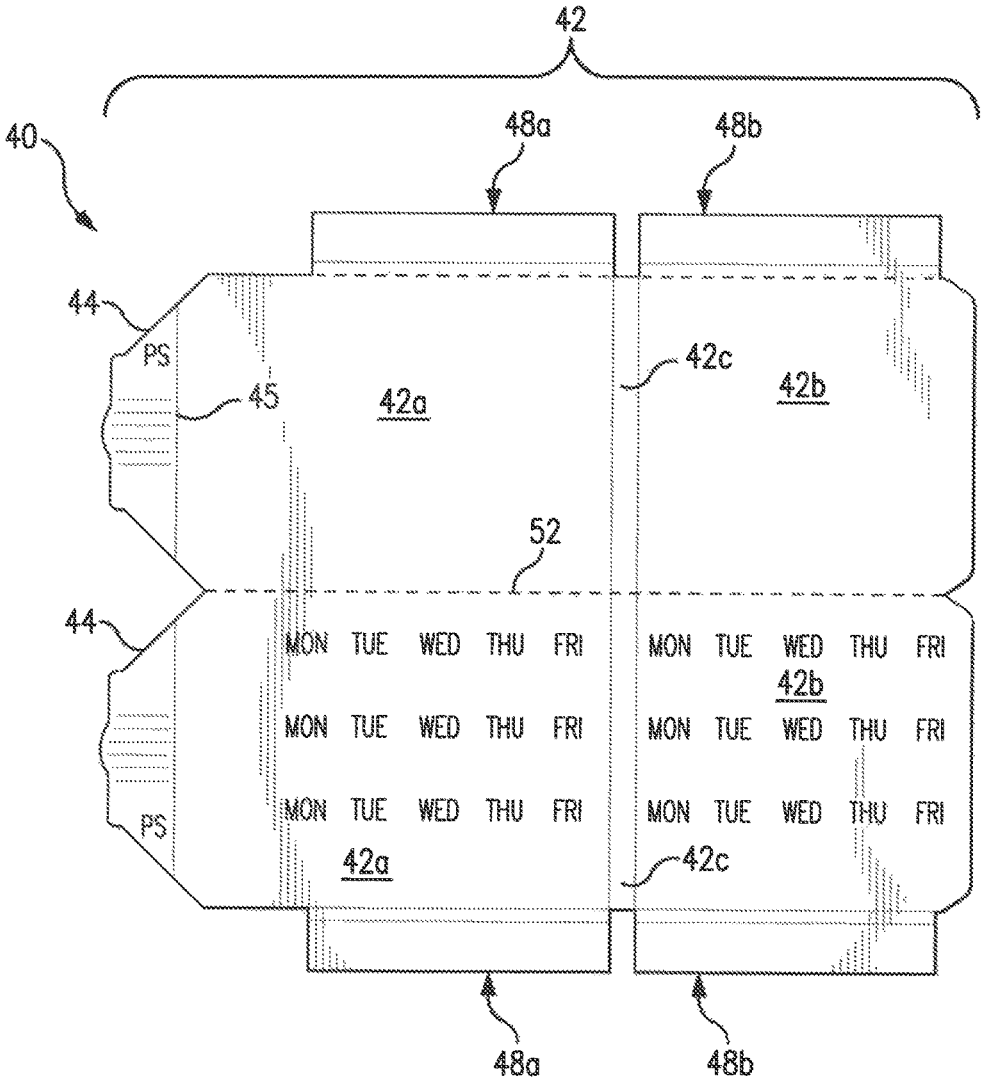
FIG. 8 is a plan view of a blank for use in making an inner product support card used in the packaging assembly of FIGS. 1 through 3.

As discussed above, the product support card 40 is slidably received within the product storage compartment 12. Referring now to FIG. 8 which illustrates a paperboard blank used to make support card 40. As shown therein, support card 40 is formed from a single sheet of paperboard material which is folded down the middle along perforation line 52 to create a two-layer card. The two layers of material can be bonded using a variety of known techniques, including adhering with glue or heat sealing. The upper layer can be provided with indicia, such as reminder information relating to the day on which a particular medication does needs to be taken.

Support card 40 includes a main body portion 42, which has three sections 42*a*-42*c* that are separated by either a crease line (shown as a solid line) or a perforation line (shown as a dashed line). A locking tail 44 extends from an end 45 of section 42*a* of the main body portion 42. The purpose and function of the locking tail 44 will be discussed in more detail below. The support card also includes two flaps 48*a*/48*b* which extend from a lateral edge of sections 42*a* and 42*b* respectively. A series of creases (solid lines) and perforation lines (dashed lines) are formed in flaps 48*a*/48*b* in order to allow the flaps to be folded as shown in FIG. 3 and present a smooth outer edge for the product support card 40 and limit the frictional drag caused when sliding the support card 40 into the interior compartment 12 of the outer carton 10.

Referring now to FIG. 3 which illustrates packaging assembly 100 in the open configuration, it can be seen that package assembly 100 includes two foil pouch blister elements 70 which have been secured to flaps 48*a*/48*b*. Those skilled in the art will appreciate that other medicament or product storage receptacles can be used in place of the foil blister pouches 70.

As discussed previously, FIG. 7 illustrates a paperboard blank that can be used to form carton 10. The paperboard blank includes several panels separated by fold, crease or perforation lines. When viewing this figure from left to right, paperboard blank includes the inner layer 16$b_1$ of the top wall panel 16*b*, side wall panel 16*c*, bottom wall panel 16*d*, side wall panel 16*a*, and outer layer 16$b_2$ of top wall panel 16*b*. These five panels are used to form the main body portion of the carton 10 and in conjunction with end flaps 19*a*/19*b* create the interior compartment 12 into which the product support card 40 is inserted.

The outer carton 10 of the package assembly 100 also includes a cover flap 22 which extends from a longitudinal edge 26 of the carton 10. The cover flap 22 can be used to display indicia, such as the product name or other product related information (e.g., drug related data or instructions) and is formed by two panels 22*a*, 22*b* and flap 22*c*.

In addition to the panels discussed above, the blank used to form the outer carton 10 also includes flaps 32, 34 and 36 which extend from panels 16$b_1$, 16*d* and 16$b_2$ respectively. Flaps 32 and 34 are joined to their respective panels through a fold line and flap 36 is joined through a perforation line.

When the outer carton is constructed, flap 36 is sandwiched between cover panels 22*a* and 22*b* and glued to one or both of the panels 22*a*/22*b*. As a result, in order to open the cover 22 and access the release mechanism 14, perforation line 38 must be severed thereby separating flap 36 from panel 16$b_2$. This arrangement provides packaging assembly 100 with a tamper-evident feature since the severed perforation line will provide a visible indication that the package assembly 100 has be previously opened.

As shown in FIG. 7, the inner layer 16$b_1$ of the top wall panel 16*b* includes a smile-shaped section cut out which creates securing ledge 18. Prior to inserting the product support card 40 into the interior storage compartment 12, the locking tail 44 of the product support card is folded along crease line 45. Then the main body portion 42 of the product support card 40 is folded along the crease lines separating sections 42*a*-42*c* and the card 40 is inserted into the interior storage compartment 12.

Upon the complete insertion of the card 40, the locking tail 44 engages with the securing ledge 18 of the outer carton 10 and as a result prevents the removal of the product support card 40 from with the product storage compartment 12. Actuation of the release mechanism 14 disengages the locking tail 44 from the securing ledge 18 allowing the product support card 40 to be partially removed from with the product storage compartment 12 until it engages with a second securing ledge created by flap 32 which projects into the compartment 12. As shown in FIG. 3, the engagement of the locking tail 44 with the second securing ledge/flap 32 prevents the complete removal of the inner support card 40 from the interior compartment 12.

Outer carton 10 also includes first and second thumb notches 47 and 48. These thumb notches 47/48 can provide finger access to the inner support card 40 to aid in removing the card from within the interior compartment 12 of the carton 10. As best viewed in FIG. 7, the first and second thumb notches 47/48 are misaligned with respect to a longitudinal axis for the outer carton 10. More specifically, thumb notch 47 is formed along the longitudinal axis or centerline for the carton 10 and thumb notch 48 is offset from the axis. This arrangement of the thumb notches serves to further enhance the child-resistant features of the package assembly 100 by making it more difficult for a child to figure out how to access the inner support car 40.

Referring now to FIGS. 4-6, 7 and 9 which provide a further packing assembly embodiment which has been designated as reference numeral 200. Packing assembly 200 is similar in construction and operation to packing assembly 100 and like elements have been identified with similar reference numerals. For example, packing assembly 200 uses the same outer carton 10 as that used in assembly 100. The main distinction between the two packing assemblies 100/200 relates to the design of the inner product support card.

Figure 9:
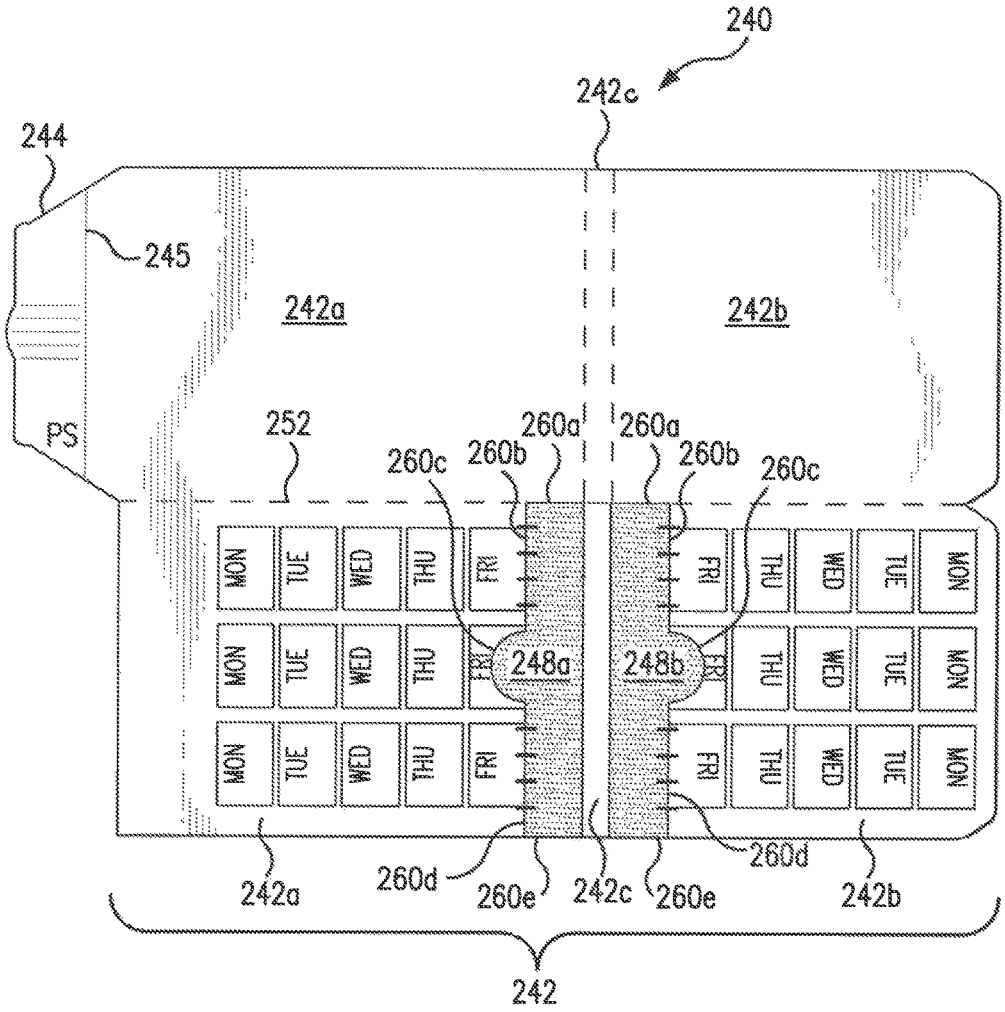
FIG. 9 is a plan view of a blank for use in making an inner product support card used in the packaging assembly of FIGS. 4 through 6.

With reference to FIG. 9 which illustrates a paperboard blank used to make inner product support card 240. As shown therein, like support card 40, product support card 240 is formed from a single sheet of paperboard material which is folded down the middle along perforation line 252 to create a two-layer card. The two layers of material can be bonded using a variety of known techniques, including adhering with glue or heat sealing.

Support card 240 includes a main body portion 242, which has three sections 242*a*-242*c* that are separated by either a crease line (shown as a solid line) or a perforation line (shown as a dashed line). A locking tail 244 extends from an end 245 of section 242*a* of the main body portion 242. The purpose and function of the locking tail 244 is similar to that described above for tail 44.

Unlike support card 40 which included laterally arranged flaps 48*a*/48*b*, product support card 240 includes two flaps 248*a* and 248*b* which extend from a middle section of the product support card 240. These flaps 248*a*/248*b* can be created by making a series of cut and perforation lines 260*a*-260*e* in the upper paperboard layer for support card 240. Also, when fabricating the two-layer card 240, adhesive or glue is not applied to the shaded region shown in FIG. 9 for the purpose of joining the two layers of material. As a result, the flaps 248*a* and 248*b* can be separated from the lower layer of material and a primary product package or foil blister pouch 270 can be secured/adhered to each flap as shown in FIG. 6.

Figure 6:
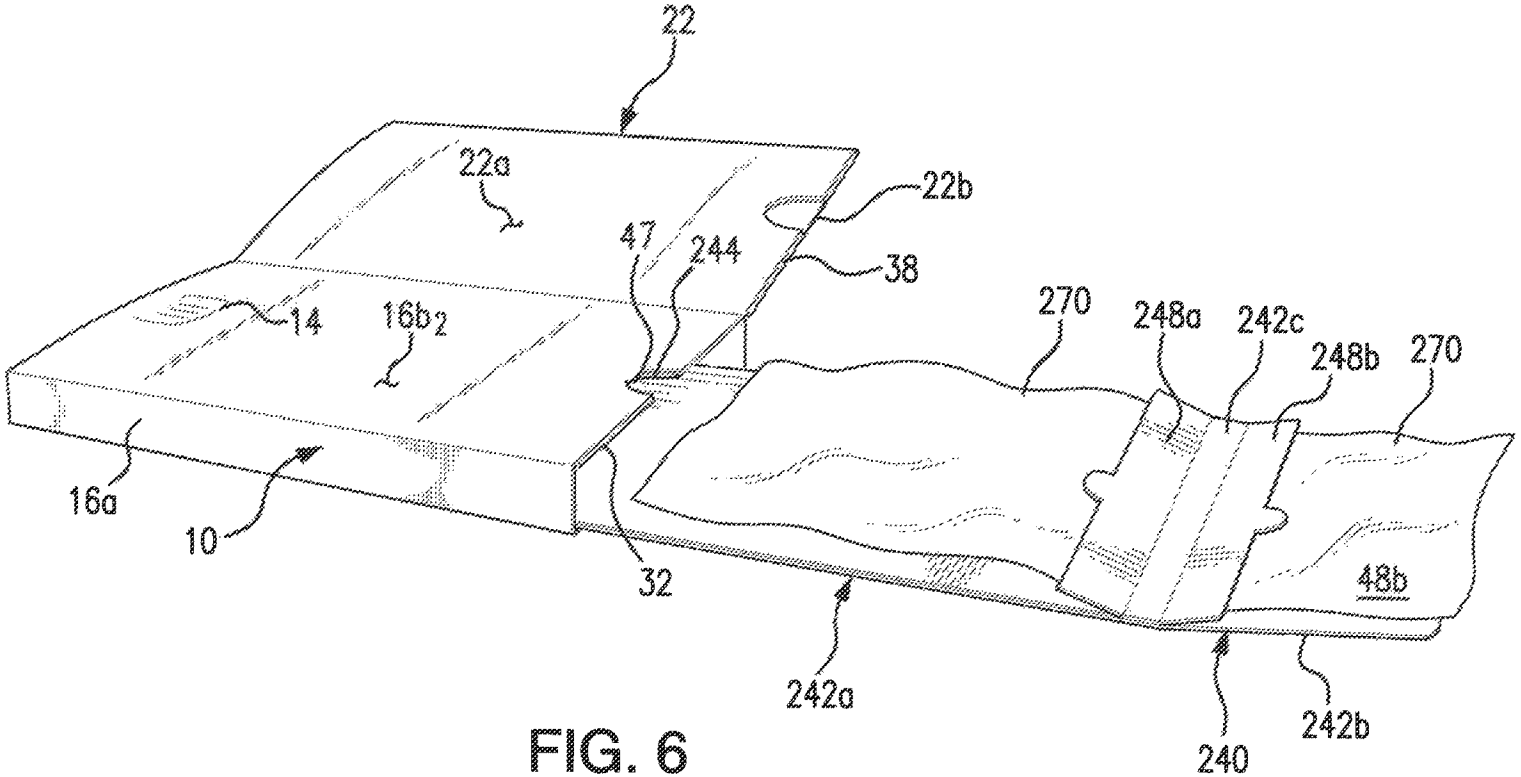
FIG. 6 illustrates a perspective view of the packaging assembly of FIG. 4 wherein the inner product support carton has been withdrawn from the interior compartment and the foil blister pouches exposed.

Also, as shown in FIGS. 6 and 9, perforation lines 260*b* and 260*d* are used in part to form flaps 248*a* and 248*b*. The reason for using a perforation line at this location is lieu of a cut line is to ensure the upper layer of the card remains intact during the manufacturing process which will make it easier to fold the card along line 252 and join the two layers. Moreover, flaps 248*a* and 248*b* have been configured to include a semi-circular shaped lifting tab which assists with the severing perforation lines 260*b* and 2060*d* so that the flaps can be lifted and a product package secured to each.

The packaging assemblies suitable for use in the present disclosure may include paper-based materials, plastics, composite materials, or combinations thereof. Various paper-based substrates may be used for the blanks. Examples of such materials include, but are not limited to, paperboard, corrugated board, cardboard, and combinations thereof.

It is believed that the present disclosure includes many other embodiments that may not be herein described in detail, but would nonetheless be appreciated by those skilled in the art from the disclosures made. Accordingly, this disclosure should not be read as being limited only to the foregoing examples or only to the designated embodiments.

What is claimed is:

1. A package assembly, comprising:

an outer carton defining an interior product storage compartment;

an inner product support card slidably received within the product storage compartment; the inner product support card having a main body portion and one or more flaps; and one or more primary product packages, each being secured to one of the one or more flaps;

wherein the one or more flaps comprise at least two flaps and wherein the at least two flaps extend from a middle section of the inner product support card.

2. The package assembly as recited in claim 1, wherein the one or more primary product packages are foil blister pouches.

3. The package assembly as recited in claim 1, wherein the inner product support card is made from two layers of paperboard.

4. The package assembly as recited in claim 3, wherein the two layers of paperboard are joined through a fold line.

5. The package assembly as recited in claim 1, wherein each of the one or more flaps has a lifting tab extending from an edge thereof.

6. The package assembly as recited in claim 1, wherein the one or more primary product packages are heat sealed, adhered with tape, or adhered with glue to the one or more flaps.

7. The package assembly as recited in claim 1, wherein the outer carton includes a release mechanism formed on a wall of the outer carton and an inner securing ledge and the inner product support card includes a locking tail extending from an end of the main body portion which engages with the securing ledge of the outer carton to prevent removal of the inner product support card from with the product storage compartment; wherein actuation of the release mechanism disengages the locking tail from the securing ledge thereby allowing the inner product support card to be at least partially removed from with the product storage compartment.

8. The package assembly as recited in claim 7, wherein the release mechanism is a push button which has been formed in the wall of the outer carton.

9. The package assembly as recited in claim 7, wherein the outer carton includes a cover flap which extends from a longitudinal edge of a main carton body.

10. The package assembly as recited in claim 9, wherein the cover flap is attached to the main carton body through a fold line and a perforation line which must be severed in order to access the release mechanism.

11. An inner product support card blank comprising:

first and second card sections separated by a fold line which extends along a central axis for the inner product support card blank, each card section including a first panel and a second panel connected through a hinge panel;

a first flap which extends from at least one of the first and second card sections;

a first primary product package secured to the first flap;

a second flap which extends from at least one of the first and second card sections; and a second primary product package secured to the second flap;

wherein a tail flap extends from an end of at least one of the first and second card sections.

12. The card blank as recited in claim 11, wherein the inner product support card blank is made from paperboard.

13. A inner product support card blank comprising: first and second card sections separated by a fold line which extends along a central axis for the inner product support card blank, each card section including a first panel and a second panel connected through a hinge panel; wherein a first flap section is defined in the first panel of the first card section and wherein a second flap section is defined in the second panel of the first card section.

14. The card blank as recited in claim 13, wherein the first and second flap sections are defined by a series of cut and perforation lines.

15. The card blank as recited in claim 13, wherein each of the first and second flap sections includes a lifting tab which extends from an edge thereof.

16. The card blank as recited in claim 13, wherein each of the first and second flap sections includes a cutout formed in an edge to facilitate lifting the tab.

17. The card blank as recited in claim 13, wherein the inner product support card blank is made from paperboard.

18. A child-resistant package assembly, comprising:

an outer carton defining an interior product storage compartment; the outer carton including a release mechanism formed on a wall for the carton and a securing ledge formed in an inner surface of the wall;

an inner product support card slidably received within the product storage compartment; the inner support card including a main body portion, a locking tail extending from an end of the main body portion and one or more flaps;

one or more primary product packages, each being secured to one of the one or more flaps; and wherein the locking tail engages with the securing ledge of the outer carton to prevent removal of the product support card from with the product storage compartment and actuation of the release mechanism disengages the locking tail from the securing ledge thereby allowing the product support card to be at least partially removed from with the product storage compartment; and wherein the one or more flaps comprise at least two flaps and wherein the at least two flaps extend from a middle section of the inner product support card.

* * * * *